US012540004B2

(12) United States Patent
Tuano et al.

(10) Patent No.: US 12,540,004 B2
(45) Date of Patent: Feb. 3, 2026

(54) PACKAGING WITH RAISING PLATFORM AND LAY-FLAT CONSTRUCTION

(71) Applicant: Apple Inc., Cupertino, CA (US)

(72) Inventors: Avianne Marie B. Tuano, San Jose, CA (US); Jeremy Bataillou, San Francisco, CA (US); Jonathan Gomez Garcia, San Francisco, CA (US); Jonathan M. Mccarren, San Francisco, CA (US); Manuel Hodrius, Potsdam (DE); Rachel Minhee Han, Green Brook, NJ (US); Thomas S. Chun, Buena Park, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/713,740

(22) Filed: Apr. 5, 2022

(65) Prior Publication Data

US 2023/0079525 A1 Mar. 16, 2023

Related U.S. Application Data

(60) Provisional application No. 63/243,356, filed on Sep. 13, 2021.

(51) Int. Cl.

| | |
|---|---|
| ***B65D 5/50*** | (2006.01) |
| ***B65D 5/20*** | (2006.01) |
| ***B65D 5/52*** | (2006.01) |
| ***B65D 5/66*** | (2006.01) |
| ***B65D 81/05*** | (2006.01) |

(52) U.S. Cl.

CPC ..... *B65D 5/5021* (2013.01); *B65D 5/2009* (2013.01); *B65D 5/5213* (2013.01); *B65D 81/057* (2013.01); *B65D 5/6664* (2013.01)

(58) Field of Classification Search

CPC .. B65D 5/5021; B65D 5/5038; B65D 5/2051; B65D 5/2004–2009; B65D 5/6664; B65D 5/5213; B65D 81/07; B65D 81/057; B65D 5/2052–5061

USPC ..... 229/123, 183, 167; 206/583, 754, 755, 206/804, 737, 757, 762, 765

See application file for complete search history.

(56) References Cited

U.S. PATENT DOCUMENTS

| | | | | |
|---|---|---|---|---|
| 1,726,732 A * | 9/1929 | Doran | B65D 5/504 206/755 |
| 1,810,956 A * | 6/1931 | Frankenstein | B65D 5/6664 229/150 |
| 2,345,716 A * | 4/1944 | Smith | B65D 5/2009 229/167 |

(Continued)

FOREIGN PATENT DOCUMENTS

| | | | | |
|---|---|---|---|---|
| FR | 1418994 A * | 11/1965 | B65D 5/2009 |
| JP | 05162741 A * | 6/1993 | |
| WO | WO-2011072806 A1 * | 6/2011 | B65D 5/28 |

*Primary Examiner* — Nathan J Newhouse
*Assistant Examiner* — Phillip Schmidt
(74) *Attorney, Agent, or Firm* — Sterne, Kessler, Goldstein & Fox P.L.L.C.

(57) ABSTRACT

Packaging may include a base box having a cavity to receive a product. Cushioning cells formed as rollover structures are configured to hold the product within the cavity. When the rollover structure rotate away from the cavity, a product support panel raises, thereby raising the product within the packaging. The packaging may also easily fold flat, without the need to remove adhesive, thereby enhancing recyclability.

17 Claims, 6 Drawing Sheets

(56) References Cited

U.S. PATENT DOCUMENTS

| | | | | |
|---|---|---|---|---|
| 2,593,778 | A | 4/1952 | McGinnis | |
| 2,951,583 | A * | 9/1960 | Sanford | B65D 5/5021 206/754 |
| 3,368,735 | A * | 2/1968 | Levi | B65D 5/0245 206/424 |
| 3,900,100 | A | 8/1975 | Girman | |
| 5,096,055 | A * | 3/1992 | Opper | B65D 5/5213 206/754 |
| 5,529,187 | A * | 6/1996 | DeNola | B65D 85/38 206/707 |
| 5,803,267 | A * | 9/1998 | Tu | B65D 5/5021 206/723 |
| 7,455,182 | B2 | 11/2008 | Merckell | |
| 8,627,958 | B2 * | 1/2014 | McDonald | B65D 5/503 206/583 |
| 9,371,151 | B2 * | 6/2016 | Nadeau | B65D 5/5038 |
| 10,301,046 | B2 * | 5/2019 | Mundt | B65D 5/6676 |
| 10,421,602 | B2 | 9/2019 | Chatelain | |
| 11,161,646 | B1 * | 11/2021 | Parrish | B65D 5/541 |
| 11,932,466 | B2 * | 3/2024 | Ito | B65D 5/5007 |
| 2010/0140333 | A1 * | 6/2010 | Mcdonald | B65D 5/5021 220/6 |
| 2014/0124395 | A1 * | 5/2014 | Nadeau | B65D 5/5038 206/250 |
| 2019/0092556 | A1 * | 3/2019 | Chou | B65D 5/5213 |

* cited by examiner

PACKAGING WITH RAISING PLATFORM AND LAY-FLAT CONSTRUCTION

CROSS REFERENCE TO RELATED APPLICATIONS

This application claims priority to and the benefit of U.S. Provisional Patent Application No. 63/243,356, filed Sep. 13, 2021, titled "Packaging With Raising Platform And Lay-Flat Construction," which is incorporated herein in its entirety by reference thereto.

FIELD

The described embodiments relate generally to packaging. More particularly, the present embodiments relate to packaging that raises a product during when opening, and has panels that stay open and unfold when the user wants to recycle the packaging. The packaging may be made of paper or other recyclable materials that may be otherwise cellulose-fiber based.

BACKGROUND

The described embodiments relate generally to packaging, including packaging that includes an interesting interactive product display element when opening, while maintaining recyclability. Product packaging is an integral part of a customer's experience. It introduces the customer to their product, and can affect the customer's feelings toward the product and the company that created it.

In some situations, such as direct-to-customer shipping, a shipping packaging such as a shipper box may be used to ship a finished goods package containing a product. Certain current shipping packaging may use retention systems using a polymeric film to retain the finished goods package within the shipper. Other shipping packaging may use expanded polystyrene cushions, or other less environmentally friendly cushioning systems. In many cases, shipping packaging does no more than hold a finished goods package, such that an opportunity to further enhance customer experience may be missed. Moreover, many current shipping packaging contains elements that are not single stream recyclable friendly, must instead be broken down into the constituent parts prior to recycling, rather than simply be unfolded to a flat and easy to recycle configuration.

What is needed is a packaging paradigm that can maintain packaging integrity prior to being received by an end user, but both increase recyclability of the packaging while improving the customer experience in receiving products or finished goods packaging containing a product when opening the shipping packaging.

SUMMARY

Some embodiments are directed to packaging having a base box having a cavity to receive a product, and a lid configured to close the base box and enclose the product within the packaging. A first rollover structure extending inward from a first sidewall of the base box is provided in some embodiments, wherein the first rollover structure is continuous with the first sidewall. A second rollover structure extending inward from a second sidewall of the base box is provided in some embodiments, wherein the second rollover structure is continuous with the second sidewall. In some embodiments, the packaging includes a product support panel, wherein the interior of the second sidewall faces the interior of the first sidewall, wherein the first and second rollover structures are configured to hold the product within the cavity, and wherein when the first rollover structure rotates away from the cavity, the product support panel raises, thereby raising the product within the packaging.

In some embodiments, the product support panel is continuous with the first and second rollover structures. The packaging may include, for example, a third rollover structure extending inward from a third sidewall of the base box, wherein the third rollover structure is continuous with the third sidewall, and a fourth rollover structure extending inward from a fourth sidewall of the base box, wherein the fourth rollover structure is continuous with the fourth sidewall, wherein the first and second, and third and fourth rollover structures, respectively, form the cavity to receive the product when the packaging is in a closed configuration.

The product support panel may include a disassembly feature, such that in a single motion the product support panel may release a locking tab such that the packaging may be unfolded to a flat configuration. The disassembly feature may include a die cut hole. The product support panel is debossed around the die cut hole in some embodiments. In some embodiments, the packaging is formed from a single, continuous cardboard blank.

Some embodiments are directed to a packaged product including the packaging and the product, wherein the product is a finished goods package containing an electronic device.

Some embodiments are directed to packaging having a product support panel to receive a product, first and second cushioning cells providing interior side panels, and third and fourth cushioning cells providing interior side panels. In some embodiments, the third and fourth cushioning cells are positioned perpendicular to the first and second cushioning cells such that a rectangular cavity is formed, wherein the product is disposed within the cavity. In response to a force applied to one or more of the cushioning cells in a direction outward from the cavity, one or more of the cushioning cells folds away from the cavity, and raises the product support panel to elevate the product.

The packaging may include a lid configured to close the packaging. In some embodiments, the lid, first and second cushioning cells, and product support panel are formed from the same blank. In some embodiments, the third and fourth cushioning cells are formed from the same blank. In some embodiments, the entire packaging is formed from a single blank of cardboard. The packaging may include a locking tab configured to be folded inward and be tucked within one of the first or second cushioning cells such that the first and second, and third and fourth cushioning cells are held generally perpendicular to each other, respectively, in a shipping configuration. In some embodiments, the third and fourth cushioning cells further include tabs spacing an interior side panel of the cushioning cell from the sidewall of the packaging such as to maintain perpendicularity when the packaging is in a closed configuration.

Some embodiments are directed to a packaged product, including the packaging and the product, wherein the product is a finished goods package containing an electronic device.

In some embodiments, the packaging includes a disassembly feature such that a user may actuate the feature to release a locking mechanism and unfold the packaging to an unfolded state. In some embodiments, no panel of the packaging is adhered to another panel of the packaging.

Some embodiments are directed to packaging having cardboard cushioning cells retaining a product in a first configuration, a cardboard lid, and a cardboard base panel, coacting with the cardboard cushioning cells to form a cavity to receive a product. In some embodiments, when the lid is opened, a subset of the cardboard cushioning cells move away from the product, thereby releasing it from the packaging. In some embodiments, the lid opening further causes a product support panel coupled to a cardboard cushioning cell to lift upward, thereby lifting the product upward. In some embodiments, the packaging is formed from a single blank.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
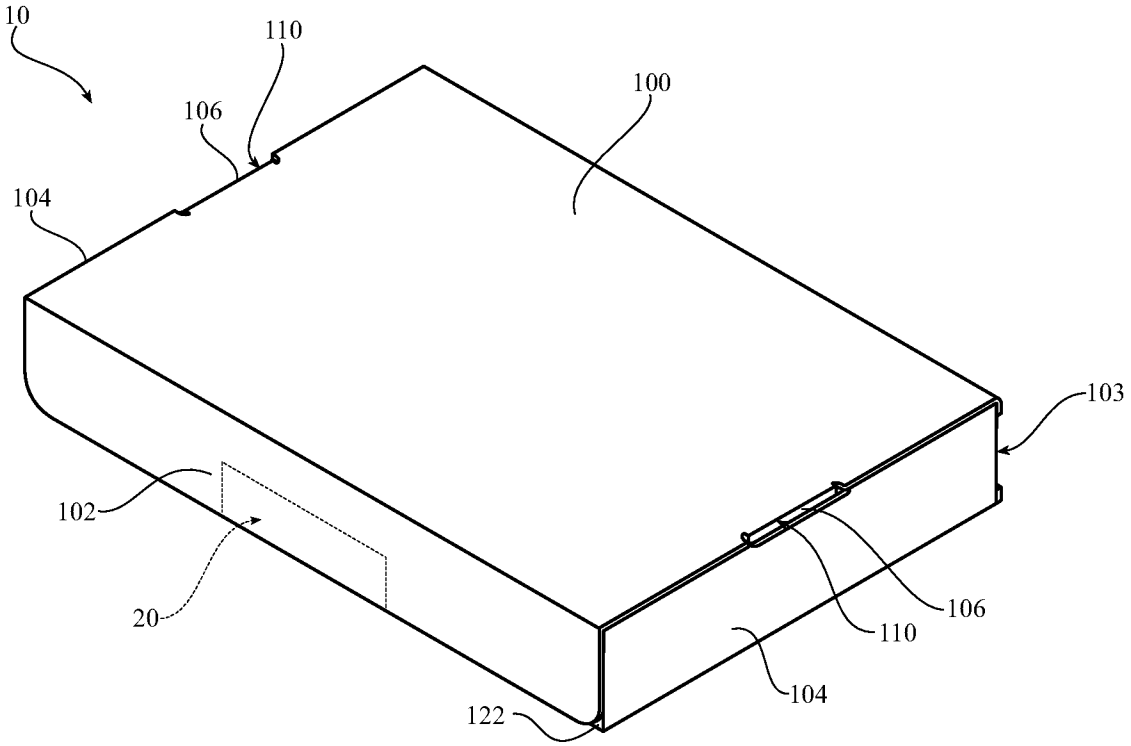
FIG. 1 shows a perspective view of packaging in an embodiment in a closed configuration.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The packaging described herein provides a packaging solution utilizing environmentally friendly materials and allows for a packaging solution that includes an integrated, lay-flat construction that may be unfolded flat for recyclability, while simultaneously providing a lifting effect when a customer opens the packaging, lifting the product or finished goods box contained in the packaging upwards toward the customer. Elements are described that achieve a structurally sound package, while allowing an end user to easily recycle the package, while providing sufficient cushioning and support during transport and enhancing an unboxing experience at the same time.

Some embodiments include packaging including a base box formed of cardboard, e.g., paperboard or cardboard corrugate (other environmentally friendly recyclable materials are also envisioned). In some embodiments, each of the base box or lid or both may be formed from a continuous sheet (e.g., a cardboard blank). In an illustrated embodiment, a single blank is used to fold the entire packaging into a usable configuration, and when the customer wishes to dispose of the packaging they are able to easily unfold the packaging into a flat blank again. Further, the unfolding of the packaging into a flat blank is possible in some embodiments without the need to tear or separate adhered portions. The respective elements may be formed of the same material or different materials that are recyclable in the same fiber-recycling stream. Advantageously, this improves upon prior systems having, for example, plastic film retention elements, adhesive, or plastic.

Companies may be sensitive to the cost of packaging and may wish to promote packaging that is eco-friendly. Packaging made out of recyclable and/or biodegradable materials, such as paper (e.g., cardboard) can reduce environmental impact, especially when it replaces a plastic film component or an expanded polystyrene component, for example. Packaging that is interesting in character and well-executed may boost a product's or a brand's reputation, thereby attracting new customers and retaining previous customers. For example, interactive elements that present a product in an interesting way when packaging is opened, e.g., lifting the product up toward the customer, welcoming the customer to their product, may enhance the customer experience. Packaging described in this document achieves these and other beneficial characteristics by balancing structural robustness, eco-friendly materials, and aesthetic elements. A product contained by the packaging may be, for example, an electronic device such as, for example, a desktop computer, monitor, laptop, tablet computer, smartphone, or smart watch, or it may be a non-electronic device. The product may also be within finished goods packaging.

In some embodiments, the packaging may be shipping packaging (e.g., packaging used for shipping a finished packaging for containing and conveying a product to a user such as may be used in a retail setting).

As described above, the packaging described herein provides a shipping packaging solution utilizing environmentally friendly materials, specifically cardboard (or other cellulose-based material). Retention and cushioning is provided by rollover structures, e.g., folded panels that are folded onto themselves to provide cushioning cells. Additional retention and cushioning features are also described herein and contemplated. Rollover structures may be further configured to be pushed out by the customer, which lifts the product upwards. While locking tabs hold the packaging together, while in use as packaging, a single motion disassembly configuration enhances recyclability.

These and other embodiments are discussed below with reference to the accompanying figures. However, those skilled in the art will readily appreciate that the detailed description given herein with respect to these figures is for explanatory purposes only and should not be construed as limiting.

FIG. 1 shows a top perspective view of packaging 10, in a closed configuration. Packaging 10 includes a lid 100, first and second sidewalls 104, rear wall 103, and closure panel 102. Packaging 10 may be described as having a base box with sidewalls, bottom, and opening, which lid 100 covers. Together, along with the bottom of the packaging, a cavity for receiving a product is provided, and packaging 10 is closed. Side tabs 106 may be tucked into packaging 10 along a top edge of respective sidewalls 104. Closure panel 102 may ensure lid 100 stays closed, for example throughout shipping in some embodiments. In some embodiments, closure panel 102 may be releasably adhered to packaging 10, via a fastener 20. For example, a tear strip may be provided as a portion of closure panel 102, or closure panel 102 may be adhesively coupled to front wall 122 (see FIG. 2) in a closed configuration. In some embodiments, the fastener may be configured as a tear strip comprising a sticker adhered across the bottom lip of the closure panel 102 and the bottom panel of packaging 10. Closure panel 102 may be mechanically locked closed, for example with a mechanical locking tab feature, such that no adhesive is required to retain packaging 10 in the closed configuration. In some embodiments, lid 100 may close over first and second sidewalls 104 to fold over and close packaging 10. Indeed, closure panel 102 may serve as a single secure point that locks the entirety of packaging 10 together in a closed, ready-to-ship configuration. Once closure panel 102 is free to move, e.g., by removing a tear strip or otherwise releasing closure panel 102 from front wall 122, the remaining features described below are able to be carried out, such as the product 40 being raised by product support panel 112, and the unfolding of the entire packaging blank flat to further enhance recyclability. The fastener/tear strip allows for packaging 10 to transform from a structurally-robust-in-shipment shipper to a customer-friendly package that presents their product and then breaks down easily for recycling.

Figure 2:
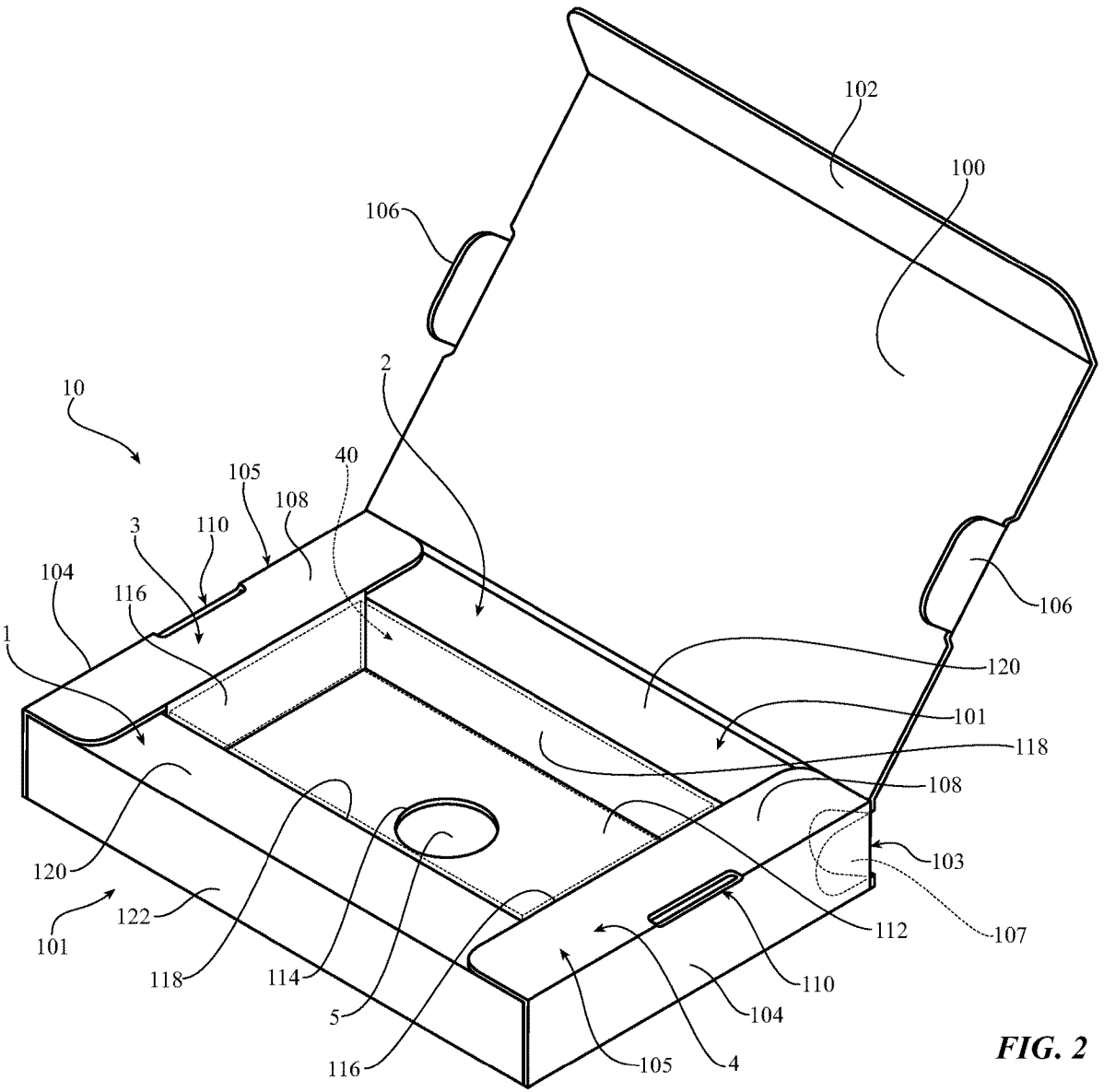
FIG. 2 shows the packaging shown in FIG. 1 as the packaging lid opens, revealing a product.

In some embodiments lid 100 may close over sidewalls 104 such that lid 100 does not extend past sidewalls 104, thereby keeping the edge of lid 100 flush with the outer surface of sidewalls 104. As shown in FIGS. 1 and 2, side tabs 106 may be folded inward to an interior surface of sidewalls 104, thereby retaining sidewalls 104 in an upright position when packaging 10 is closed (i.e., when side tabs 106 are received within slots 110). In some embodiments, a lid may be provided separately, or extending from a short side of the base box sidewall, rather a longer side as shown in FIG. 1.

Turning to FIG. 2, packaging 10 is shown in an open configuration, retaining product 40 in a cavity formed generally by interior side panels 116 and 118. Interior side panels 116 and 118 are formed by folding respective panels inward as rollover structures. First rollover structure 1 and second rollover structure 2 may be formed along the length direction of the packaging 10 shown in the figures, and third and fourth rollover structures (3 and 4, respectively) may be formed along the width direction of the packaging 10. In a closed and locked configuration, interior side panels 116 and 118 position, retain, and provide cushioning for product 40. In some embodiments, the product (e.g., product 40) described may be a finished goods package, itself housing a product or products inside. In some embodiments, the packaging may house multiple products, and the rollover structures described herein may support a plurality of products.

Lid 100 may be folded outward, allowing side tabs 106 to be removed from slots 110. Slots 110 are formed such that side tabs 106 may be inserted to an inner side of sidewalls 104, while retention panel 108 folds inward towards the interior of packaging 10, thereby holding lid 100 and sidewalls 104 together when the packaging is in a closed configuration. Side tabs 106 cooperate with closure panel 102 to keep packaging 10 in a closed position (e.g., during shipping). Retention panels 108 fold inward from sidewalls 104, and on top of upper rollover panel 120, thereby positioning and retaining both upper rollover panel 120 along with front wall 122 in position when packaging 10 is in a closed configuration. Similarly, on the back side of packaging 10 proximate the extension of lid 100, upper rollover panel 120 is positioned and retained and held in position. Interior side panels 116 and 118, respectively, are shown in a paired, generally perpendicular relationship (e.g., two interior side panels 116 are parallel to each other, two interior side panels 118 are parallel to each other, and the side panels 116 are perpendicular to the side panels 118), thereby providing a generally rectangular cavity for product 40 to be received within.

Lid 100, along with the base panel 5 of packaging 10 and the cushioning cells such as rollover structures 101 and 103 coact to form a cavity to receive and maintain product 40 in a position within packaging 10 during shipping. As shown in FIG. 2, locking tab 107 is shown in two positions: in a first position folded and tucked in generally parallel to sidewall 104, and in a second position folded further such that it engages with an interior of rollover structure 101. In either configuration, locking tab 107 (and another, symmetrical locking tab on the opposite side of the packaging) effectively couple rollover structure 101 with lid 100 when folded in place (e.g., when locking tabs 107 are folded in the second position). This means that as the lid 100 is further rotated when opening packaging 10, the rollover structure rotates outward, raising interior side panel 118, which in turn raises product support panel 112. Put another way, as the distance between upper rollover panels 120 increases, product support panel 112 raises to accommodate the increased distance because it is connected to each of upper rollover panels 120 via interior side panels 118. Put simply, product support panel 112 may be continuous with the rollover structures at shared folds.

While lid 100 is shown to extend over the entire top portion of packaging 10, in some embodiments, multiple lids may be provided, such as doors that open to either side of a packaging. In this way, each lid may be separately coupled or extend from a respective rollover structure, such that the articulation of each lid opening may raise product 40.

Figure 3:
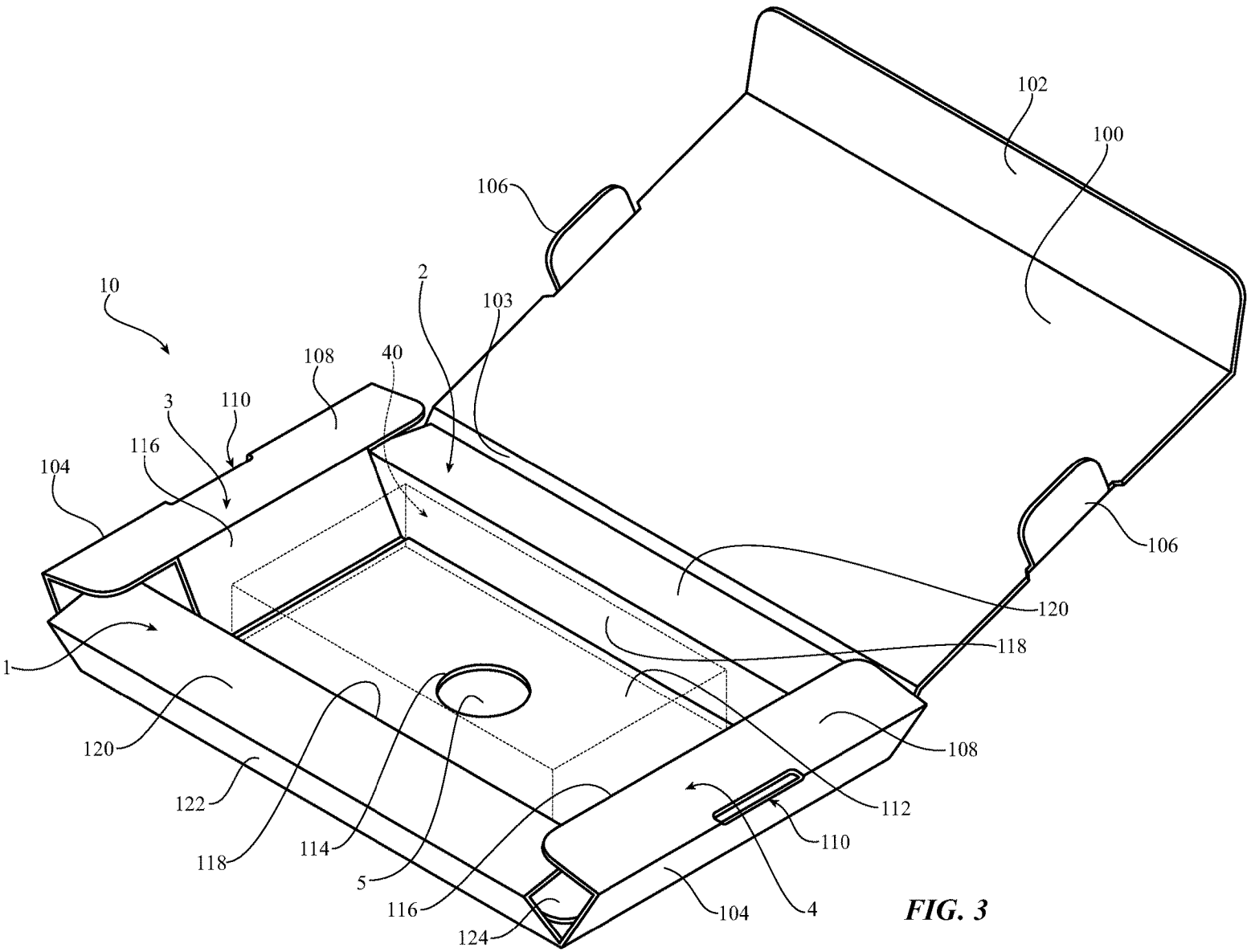
FIG. 3 shows the packaging shown in FIG. 1 as the packaging continues to open, thereby raising product and opening the cavity in which the product was contained in the closed configuration.

A product support panel 112 is shown at the bottom of the cavity where product 40 is placed. A first interior side panel 118 closest to and parallel to front wall 122, along with upper rollover panel 120, are received in a space formed by interior side panel 116, retention panel 108, and sidewall 104. In this way, the rollover structure may be tucked into position such that packaging 100 may be closed. As shown in FIGS. 2 and 3, a lower rollover panel 124 extends from a first interior side panel 118 towards front wall 122, thereby providing a cushioning cell. In general, as one or more rollover structures rotates away from the cavity, e.g., in response to a force applied to one or more of the cushioning cells in a direction outward from the cavity, product support panel 112 raises, thereby raising product 40 within packaging 10. This movement additionally expands the cavity that product 40 is received within, such that a consumer may grab product 40 to remove it from packaging 10. In some embodiments, each cushioning cell/rollover structure may rotate outward separately. In some embodiments, the cushioning cells/rollover structures may rotate outward simultaneously. In some embodiments, the cushioning cells/rollover structures may rotate outward in pairs, such as pairs of parallel structures. In some embodiments, product support panel 112 raises a portion of product 40 above the cavity.

FIG. 3 shows packaging 10 in an open configuration, where rollover structures have been rotated outward, thereby raising product support panel 112 upward and away from base panel 5, and in turn raising product 40. Support panel 112 lifts away and is spaced apart from the underlying base panel 5. In some embodiments, product support panel 112 is integrally formed with sidewalls 118. As sidewalls 118 fold outward when packaging 10 is opened, this in turn raises product support panel 112 such that product 40 is presented to the customer. In some embodiments, as interior side panels 116 fold outward from product 40 (e.g., in response to a consumer providing a force outward), interior side panels 116 and support panel 124 may also pivot upward, aiding in raising product support panel 112 and in turn product 40. Lower rollover panels 124 connected to interior side panels 116 slide underneath product support panel 112 as rollover structures 105 rotate away from the cavity product 40 is received within. When product 40 is removed from packaging 10, disassembly feature 114 may be revealed as part of product support panel 112.

Disassembly feature 114 may be, for example, a hole cut through product support panel 112 such that a user may grasp the feature and pull upward. In some embodiments, the hole formed may be dimensioned so as to accommodate a user's finger diameter such that pulling the feature (along with product support panel 112) is made easy for the user. Other features such as debossing, embossing, texture, etc., may be provided to enhance the customer experience and function of disassembling packaging 10. Further, in some embodiments, the surface of disassembly feature may be configured in a way, such as debossing, so as to increase consumer comfort when grabbing the feature. Additionally, by debossing disassembly feature 112, a lower surface of product 40 (e.g., a finished-goods box or product itself) is protected from a potentially sharp corrugate edge (such as may be formed when corrugate is die-cut), thereby protecting the cosmetic appearance of product 40.

In some embodiments, disassembly feature 114 may include an indicator, such as a recycling icon that visually communicates to a consumer the purpose of disassembly feature 114. In some embodiments, the indicator may be embossed or debossed, or be in the form of a sticker, either on the disassembly feature itself or on the lower panel visible through disassembly feature 114. In a single pulling motion, product support panel 112 (connected to rollover structure 101 closest to lid 100) may be pulled up and away, thereby releasing locking tab 107 and allowing retention panels 108 to further pivot away from the cavity. As retention panels 108 pivot away, they release upper rollover panels 120, such that the entirety of rollover structures 101 and product support panel 112 may be folded outward in the direction opposite of the opening direction of lid 100. This configuration allows packaging 10 to be unfolded to a flat configuration easily, enhancing recyclability. This configuration provides for packaging that can be disassembled into a flat blank-without the need to tear or crush any portion of the packaging, and without needing to separate any adhered parts. This improves upon packaging that requires such actions a consumer might need to do when breaking down a box for recycling.

Figure 4:
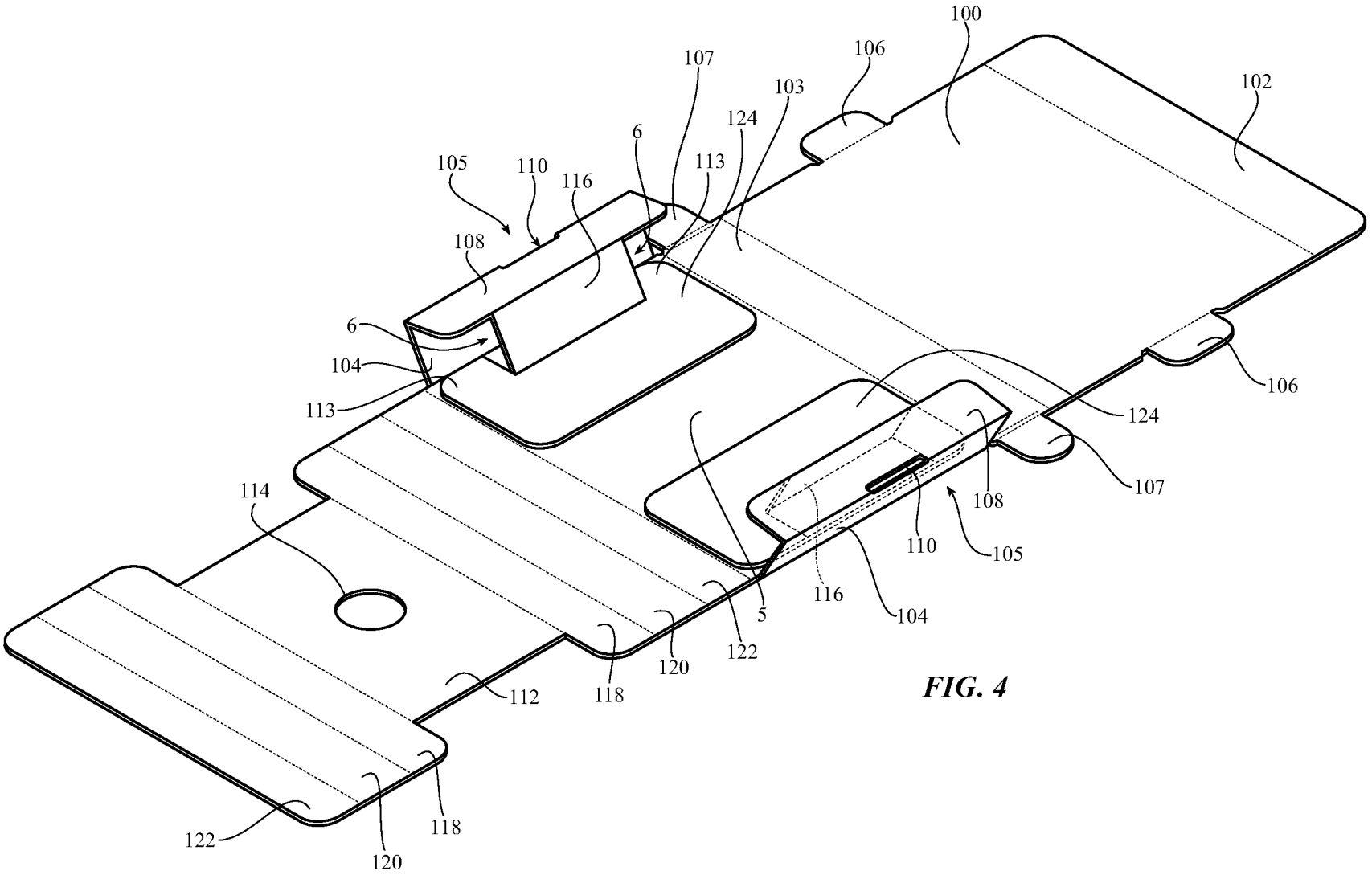
FIG. 4 shows a perspective view of packaging shown in FIGS. 1-3, in a mostly unfolded configuration.

FIG. 4 shows packaging 10 in a mostly-unfolded configuration. Rollover structures 105 are folded inward towards where a cavity would be formed, such that lower rollover panels 124 are folded onto the base panel 5 of the packaging. As shown, tabs 113 are cut from interior side panels 116, such that they may receive the structure and engage sidewalls 104. Tabs 113 may provide lateral positioning of interior side panels 116 and sidewalls 104 such that they may be generally parallel in a folded, closed configuration of packaging 10. A pocket 6 is formed on either side of interior side panel 116, that may receive rollover structure 101 in a folded, closed configuration of packaging 10. And as shown in FIG. 4, once locking tab 107 is free, there are no additional locking structures holding the blank together. This means that a customer may easily fold the entirety of packaging 10 flat, thereby enhancing recyclability. By providing an easy way to fold the entirety of packaging 10 flat, better use of space for a consumers recycling bins is achieved. Since individual recycling bins are constrained for space, consumers may typically break down cardboard to dispose of it. Packaging 10's ability to be easily broken down is a benefit in and of itself, and makes it more likely to be actually recycled.

As discussed herein, components of the packaging described may be formed from one or more blanks, e.g., cardboard or paper blanks. In some embodiments, the blank is formed of a single continuous substrate, such as, for example cellulose-based material like cardboard corrugate. Other cellulose-based materials are contemplated, such as paperboard, certain molded fiber components of sufficient construction, or grayboard.

Figure 5:
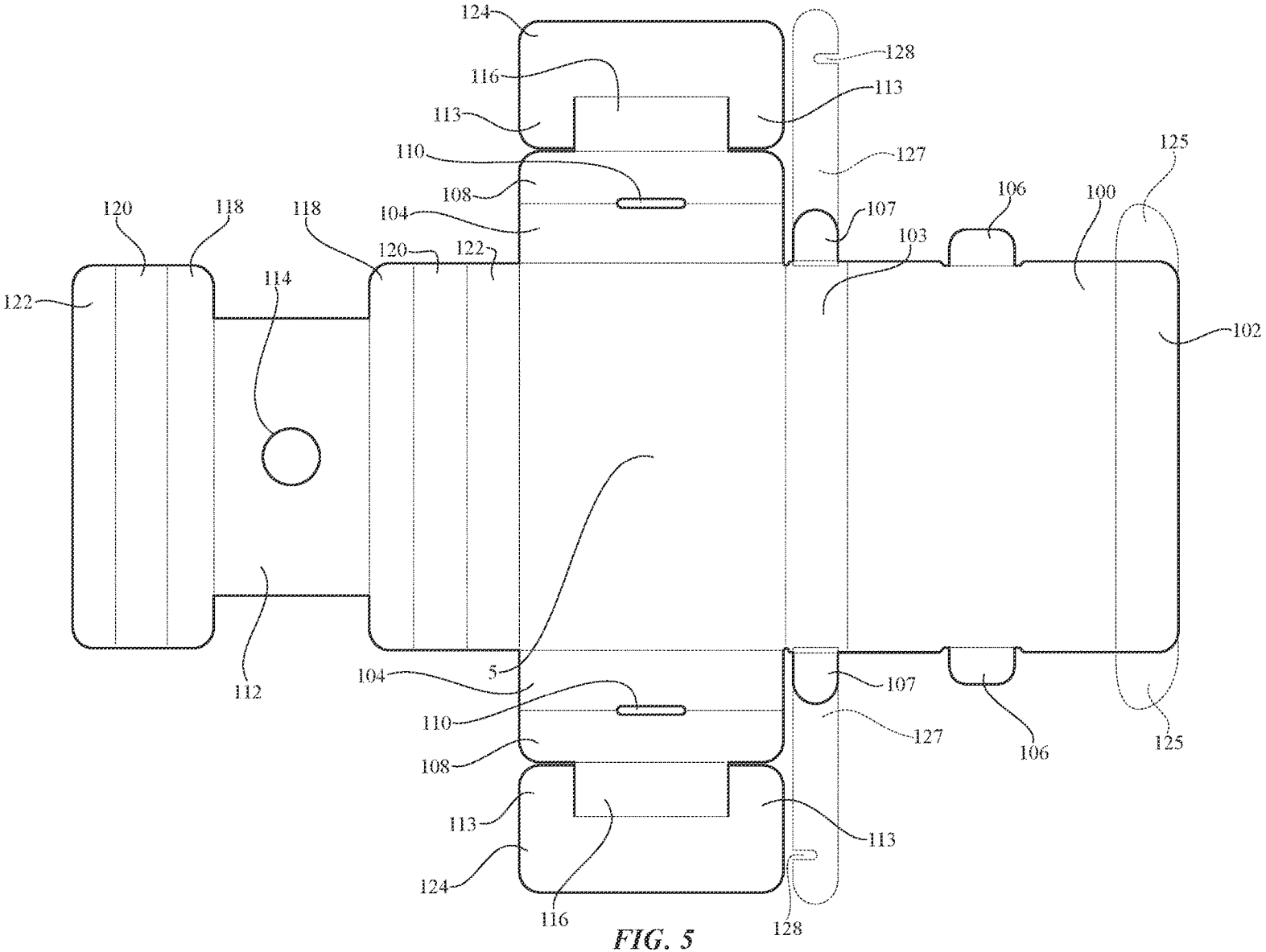
FIG. 5 shows a view of a blank used to produce the packaging of FIG. 1, and also shows an unfolded configuration of the packaging in FIG. 1, for example when a user desires to recycle the packaging.

Turning to FIG. 5, a view of a blank used to produce the packaging 10 is shown (and may also be representative of an unfolded, ready-to-recycle packaging after a customer decides to dispose of packaging 10). As seen in FIG. 5, the left-most extension of the panel folds over towards the lid, such that both of rollover structures 101 may be formed, with product support panel 112 connecting the two. In some embodiments, these are folded inward after rollover structures 105 are folded inward, e.g., from the top and bottom portions of the blank shown in FIG. 5. This single-blank configuration improves upon designs that require multiple blanks fixed together via adhesive, in terms of manufacturability, assembly, and recyclability. As can be appreciated, the dimensions of the constituent panels and walls of the blank may be varied to accommodate different sizes and shapes of products or finished goods packaging, when the blank is folded into a configuration to receive such products or finished goods packaging. But while the dimensions and shapes may vary, the design may be scaled such that assembly is substantially the same, notwithstanding any dimensional differentiation. In some embodiments, the blank used to produce packaging 10 includes front locking tabs 125, which in use can be tucked into the front of packaging 10 between side panels 104 and front wall 122. In some embodiments, the blank used to produce packaging 10 includes back panel locking tabs 127, having notches 128. In use, back panel locking tabs 127 may be folded toward each other to engage with an interior of rollover structure 101 in a similar manner as described with respect to locking tabs 107, and in addition may engage with each other at their respective notches 128 to help maintain back panel locking tabs 127 in position. This configuration may provide added strength and security than shorter locking tabs 107. Additionally, by securing notches 128 together during assembly, the product support panel 112 and connected panels may be held in place while the rollover structures are folded into place.

Figure 6:
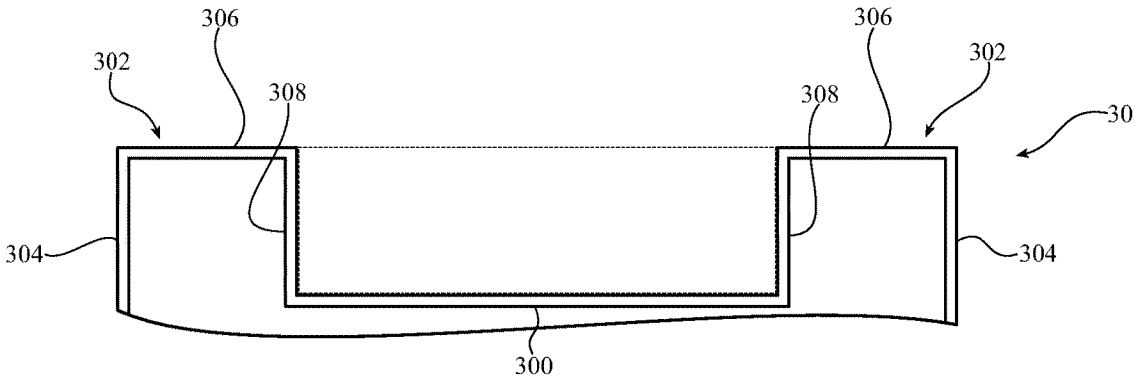
FIG. 6 shows a partial schematic side view of packaging with a product in a first configuration.
Figure 7:
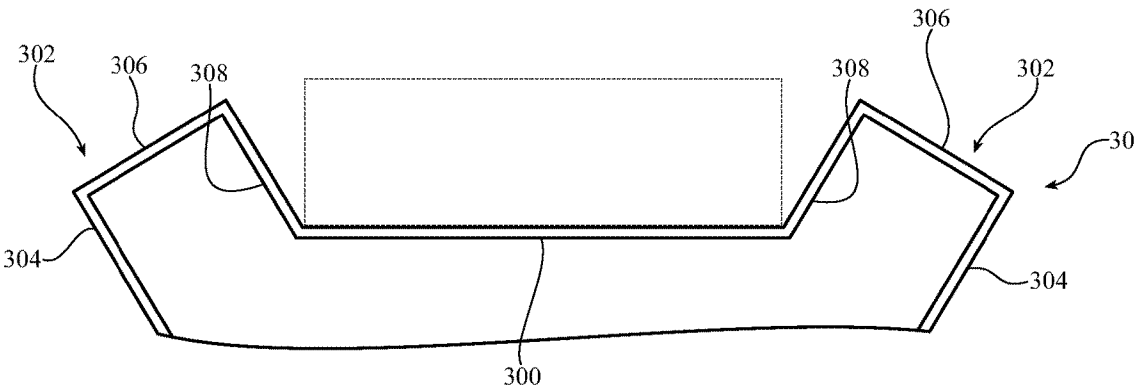
FIG. 7 shows a partial schematic side view of packaging with a product in a second configuration.

Turning to FIGS. 6 and 7, a schematic section view of packaging similar to packaging 10 is shown having a first configuration shown in FIG. 6, and second configuration shown in FIG. 7. FIG. 6 shows a product in a retained configuration, whereby it is positioned within packaging 30, received in a cavity formed by product support panel 300 and interior sidewalls 308 form cushioning cells 302 (which may be formed further as rollover structures).

As FIG. 7 shows, when cushioning cells 302 are rotated outward from the product shown in dashed lines, by virtue of relative fixing of the panels, product support panel 300 is lifted upwards, thereby raising the product and releasing it from the cavity of packaging 30. FIGS. 6 and 7 illustrate in a simplified form the raising mechanism that enhances the customer experience opening packaging that raises the product that it contains when being opened. Conceptually, the cushioning cells 302 shown in FIGS. 6-7 are similar to the cushioning cells and rollover structures shown in FIGS. 1-4.

As shown, the lifting of the product shown is due at least in part to the cushioning cells sharing folds with the product support panel 300.

Each of the components may be composed of recyclable materials including the shipping packaging, finished packaging, seals, and other related components. Thus, if and when the customer opts to dispose of the packaging, the packaging may simply be recycled without requiring material separation (e.g., in a single-stream recycling program). Advantageously, this improves upon prior systems having, for example, retention film shipping systems or polystyrene cushioning.

Each of the components and their constituent parts, and other variations described herein may include corresponding features described with reference to each of the other components and features described without limitation.

In some embodiments, any surface finishing may take place after the components are cut from the blank, or alternatively prior to the blank being cut into separate sheets for assembling to a final product. Additionally, some operations may be performed concurrently. All or some of the surfaces of the packaging may be coated, or laminated, which may increase structural strength properties such as rigidity and which may protect a product within the packaging, or avoid scratching.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material (e.g., a sheet of cardboard corrugate, or roll of material), or other fiber or cellulose based material. Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. Packaging, comprising:

a base box having a cavity to receive a product;

a lid configured to close the base box and enclose the product within the packaging;

a first rollover structure extending inward from a first sidewall of the base box, the first rollover structure further comprising:

an upper rollover panel extending at a fold at the top of the first sidewall when the packaging is in a closed position; and an interior side panel extending adjacent to a bottom wall when the packaging is in a closed position, wherein the first rollover structure is continuous with the first sidewall;

a second rollover structure extending inward from a second sidewall of the base box, wherein the second rollover structure is continuous with the second sidewall;

a third rollover structure extending inward from a third sidewall of the base box;

a fourth rollover structure extending inward from a fourth sidewall of the base box, wherein the first and second, and third and fourth rollover structures, respectively, form the cavity to receive the product when the packaging is in a closed configuration; and a product support panel, wherein the interior of the second sidewall faces the interior of the first sidewall, wherein the first and second rollover structures are configured to hold the product within the cavity, and wherein when the first rollover structure rotates away from the cavity, the product support panel raises, thereby raising the product within the packaging.

2. The packaging of claim 1, wherein the product support panel is continuous with the first and second rollover structures.

3. The packaging of claim 1, wherein the product support panel comprises a disassembly feature, such that in a single motion the product support panel may release a locking tab such that the packaging may be unfolded to a flat configuration.

4. The packaging of claim 3, wherein the disassembly feature comprises a die cut hole.

5. The packaging of claim 4, wherein the product support panel is debossed around the die cut hole.

6. The packaging of claim 1, wherein the packaging is formed from a single, continuous cardboard blank.

7. A packaged product, comprising: the packaging of claim 1; and the product, wherein the product is a finished goods package containing an electronic device.

8. Packaging, comprising:

a product support panel to receive a product;

first and second cushioning cells providing interior side panels spaced from respective first and second outer side walls of the packaging, wherein the spacing is provided by respective upper rollover panels extending from a top edge of the respective interior side panel; and third and fourth cushioning cells providing interior side panels, the third and fourth cushioning cells positioned perpendicular to the first and second cushioning cells such that a rectangular cavity is formed, wherein the product is disposed within the cavity, wherein no panel of the packaging is adhered to another panel of the packaging, and wherein in response to a force applied to one or more of the cushioning cells in a direction outward from the cavity, one or more of the cushioning cells folds away from the cavity, and raises the product support panel to elevate the product.

9. The packaging of claim 8, further comprising a lid configured to close the packaging, wherein the lid, first and second cushioning cells, and product support panel are formed from the same blank.

10. The packaging of claim 9, wherein the third and fourth cushioning cells are formed from the same blank.

11. The packaging of claim 8, wherein the entire packaging is formed from a single blank of cardboard.

12. The packaging of claim 8, further comprising:

a locking tab configured to be folded inward and be tucked within one of the first or second cushioning cells such that the first and second, and third and fourth cushioning cells are held generally perpendicular to each other, respectively, in a shipping configuration.

13. The packaging of claim 8, wherein the third and fourth cushioning cells further comprise tabs spacing an interior side panel of the cushioning cell from the sidewall of the packaging such as to maintain perpendicularity when the packaging is in a closed configuration.

14. A packaged product, comprising: the packaging of claim 8; and the product, wherein the product is a finished goods package containing an electronic device.

15. The packaging of claim 8, wherein the packaging includes a disassembly feature such that a user may actuate the feature to release a locking mechanism and unfold the packaging to an unfolded state.

16. Packaging, comprising:

cardboard cushioning cells retaining a product in a first configuration;

a cardboard lid coupled to a sidewall of one of the cardboard cushioning cells; and a cardboard base panel, coacting with the cardboard cushioning cells to form a cavity to receive a product, wherein when the lid is opened, the articulation of the lid opening moves the sidewall coupled to the cardboard lid away from the product, thereby releasing it from the packaging, and wherein no panel of the packaging is adhered to another panel of the packaging, and wherein the movement of the sidewall coupled to the cardboard lid further away from the product causes a product support panel coupled to the cardboard cushioning cell coupled to the lid to lift upward, thereby lifting the product upward.

17. The packaging of claim 16, wherein the packaging is formed from a single blank.

* * * * *